US012644405B2

(12) United States Patent
He et al.

(10) Patent No.: US 12,644,405 B2
(45) Date of Patent: Jun. 2, 2026

(54) LUBRICATION OIL WARM-UP FOR A FLUID PUMP

(71) Applicant: Caterpillar Inc., Peoria, IL (US)

(72) Inventors: Yuesheng He, Sugar Land, TX (US); Todd Ryan Kabrich, Tomball, TX (US); Jared M. Kirk, Peoria, IL (US); David J. Schuh, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 31 days.

(21) Appl. No.: 18/793,228

(22) Filed: Aug. 2, 2024

(65) Prior Publication Data

US 2026/0036074 A1 Feb. 5, 2026

(51) Int. Cl.

| | |
|---|---|
| ***F01P 3/20*** | (2006.01) |
| ***F01P 7/14*** | (2006.01) |
| ***F01P 7/16*** | (2006.01) |

(52) U.S. Cl.

CPC ..... *F01P 3/20* (2013.01); *F01P 7/16* (2013.01); *F01P 2007/146* (2013.01); *F01P 2037/00* (2013.01); *F01P 2060/045* (2013.01)

(58) Field of Classification Search

CPC ..... F01P 7/16; F01P 3/20; F01P 2007/146; F01P 2023/00

See application file for complete search history.

(56) References Cited

U.S. PATENT DOCUMENTS

| | | | | |
|---|---|---|---|---|
| 10,123,403 | B2 * | 11/2018 | Trickler | H05B 45/20 |
| 10,234,016 | B2 * | 3/2019 | Shiina | F16H 57/0417 |
| 2010/0056330 | A1 | 3/2010 | Schuh | |
| 2013/0152882 | A1 * | 6/2013 | Potter | F16H 57/0413 184/104.1 |
| 2021/0123373 | A1 * | 4/2021 | Park | F01P 5/10 |

FOREIGN PATENT DOCUMENTS

| | | | |
|---|---|---|---|
| CN | 201925157 | U | 8/2011 |
| CN | 112160904 | A | 1/2021 |
| CN | 212272526 | U | 1/2021 |
| CN | 216767740 | U | 6/2022 |
| CN | 114718537 | A | 7/2022 |
| CN | 216895706 | U | 7/2022 |
| CN | 220267680 | U | 12/2023 |

* cited by examiner

*Primary Examiner* — Kevin A Lathers

(57) ABSTRACT

A controller may cause, in a lubrication oil warm-up mode of a transmission, the transmission to operate in a stall mode that transfers heat to transmission oil for the transmission. The transmission oil may be diverted to a lubrication oil heater to heat the lubrication oil using the transmission oil. The controller may cause the transmission to disengage the stall mode and to engage a park mode, to pause the lubrication oil warm-up mode. The controller may cause the transmission to operate in the stall mode, to resume the lubrication oil warm-up mode, after the pause duration.

12 Claims, 5 Drawing Sheets

LUBRICATION OIL WARM-UP FOR A FLUID PUMP

TECHNICAL FIELD

The present disclosure relates generally to fluid pumps and, for example, to lubrication oil warm-up for a fluid pump.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. The injected fluid may be pressurized by a fluid pump that is powered by an engine. The pump may be lubricated by a lubrication oil, and to ensure reliable and high-performance operation of the fluid pump, the lubrication oil should be sufficiently warm (e.g., above 75° Fahrenheit (F)) before the pump is operated. However, in a cold environment, it may take several hours of engine idling to warm the lubrication oil, leading to significant downtime of the pump.

The fluid system of the present disclosure solves one or more of the problems set forth above and/or other problems in the art.

SUMMARY

A fluid system may include an engine cooling system to circulate engine coolant in an engine, a transmission lubrication system to circulate transmission oil in a transmission, and a pump lubrication system to circulate lubrication oil in a fluid pump. The pump lubrication system may include a lubrication oil heater to heat the lubrication oil circulated through the lubrication oil heater using the transmission oil. The pump lubrication system may include a lubrication oil cooler, in parallel with the lubrication oil heater, to cool the lubrication oil circulated through the lubrication oil cooler using the engine coolant. The pump lubrication system may include a lubrication oil mixer to mix heated lubrication oil from the lubrication oil heater and cooled lubrication oil from the lubrication oil cooler, and to supply mixed lubrication oil to the fluid pump. The fluid system may include a controller configured to cause, in a lubrication oil warm-up mode, the transmission to operate in a stall mode that transfers heat to the transmission oil.

A method of heating lubrication oil for a fluid pump coupled to a transmission may include causing, by a controller in a lubrication oil warm-up mode of the transmission, the transmission to operate in a stall mode that transfers heat to transmission oil for the transmission. The transmission oil may be diverted to a lubrication oil heater to heat the lubrication oil using the transmission oil. The method may include causing, by the controller for a pause duration, the transmission to disengage the stall mode and to engage a park mode, to pause the lubrication oil warm-up mode. The method may include causing, by the controller, the transmission to operate in the stall mode, to resume the lubrication oil warm-up mode, after the pause duration.

A pump system may include an engine, a transmission coupled to the engine via a torque converter, a fluid pump coupled to the engine via the transmission, and a pump lubrication system to circulate lubrication oil in the fluid pump. The pump lubrication system may include a lubrication oil heater to heat the lubrication oil circulated through the lubrication oil heater using transmission oil. The pump lubrication system may include a lubrication oil cooler, in parallel with the lubrication oil heater, to cool the lubrication oil circulated through the lubrication oil cooler using engine coolant. The pump lubrication system may include a lubrication oil mixer to mix heated lubrication oil from the lubrication oil heater and cooled lubrication oil from the lubrication oil cooler, and to supply mixed lubrication oil to the fluid pump.

DETAILED DESCRIPTION

Figure 1:
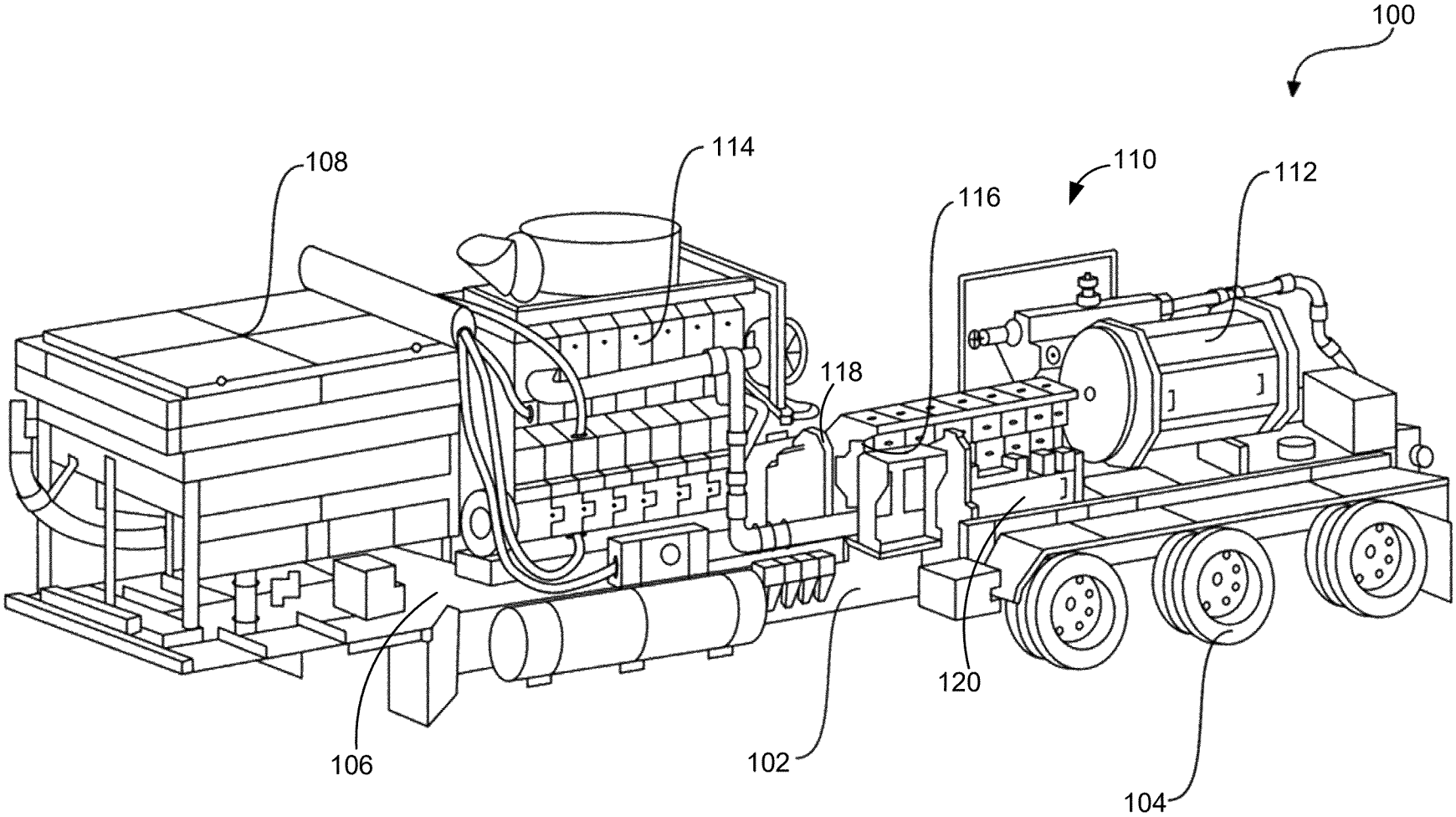
FIG. 1 is a perspective view of an example trailer.

FIG. 1 is a perspective view of an example trailer 100. The trailer 100 may be, or may be included in, a hydraulic fracturing system. For example, the trailer 100 may be used in hydraulic fracturing operations at a hydraulic fracturing site. As an example, the trailer 100 may be used in connection with high-pressure injection of fracturing fluid into a well and corresponding wellbore in order to hydraulically fracture a rock formation surrounding the wellbore. Thus, in some contexts, the trailer 100 may be referred to as a "hydraulic fracturing rig."

The trailer 100 includes a frame 102 and wheels 104 coupled to the frame 102. The wheels 104 provide mobility for the trailer 100 to enable the trailer to be towed (e.g., by a truck or tractor unit), such as to different hydraulic fracturing sites or to different locations within a hydraulic fracturing site. The frame 102 supports a trailer bed 106 (e.g., a flat surface on which equipment can be secured and transported).

The trailer 100 may include a cooling system 108 and/or a pump system 110 mounted on the trailer bed 106. The cooling system 108 may operationally cool, or otherwise remove thermal energy from, the pump system 110 and/or other components of the trailer 100. For example, the cooling system 108 may pump cooling fluid (e.g., oil, water, or the like) to components of the pump system 110 and/or other components of the trailer 100.

The pump system 110 may include a fluid pump 112, an engine 114, and a transmission 116, among other examples, mounted on the trailer bed 106. The fluid pump 112 may be a reciprocating positive-displacement pump, such as a hydraulic fracturing pump. The fluid pump 112 may include a type of high-volume hydraulic fracturing pump, such as a triplex or quintuplex pump. For example, the fluid pump 112 may have a capability to produce a maximum discharge pressure of at least 10,000 psi, at least 15,000 psi, or at least 20,000 psi. A type and/or a configuration of the fluid pump 112 may vary depending on the fracture gradient of the rock formation that will be hydraulically fractured, the quantity of fluid pumps 112 used in a hydraulic fracturing system, a flow rate necessary to complete the hydraulic fracture, the pressure necessary to complete the hydraulic fracture, or the like.

The engine 114 may be operably coupled to the fluid pump 112 via the transmission 116. Thus, the engine 114 may drive the fluid pump 112, thereby providing the power for pressurization of fracturing fluid by the fluid pump 112. In some implementations, the engine 114 and the transmission 116 may be coupled via a torque converter 118, which is described in connection with FIG. 2. The engine 114 may be an internal combustion engine, such as a gaseous fuel engine (e.g., a spark-ignited gaseous fuel engine), a diesel engine (e.g., a diesel-compression ignition engine), a gasoline engine, or the like. The transmission 116 may be an automatic transmission, a continuous variable transmission (CVT), or a clutch transmission, among other examples.

As further shown, the pump system 110 may include a controller 120. The controller 120 may be configured to perform operations associated with lubrication oil warm-up, as described herein. The controller 120 may include one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the controller 120.

As indicated above, FIG. 1 is provided as an example. Other examples may differ from what is described with regard to FIG. 1.

Figure 2:
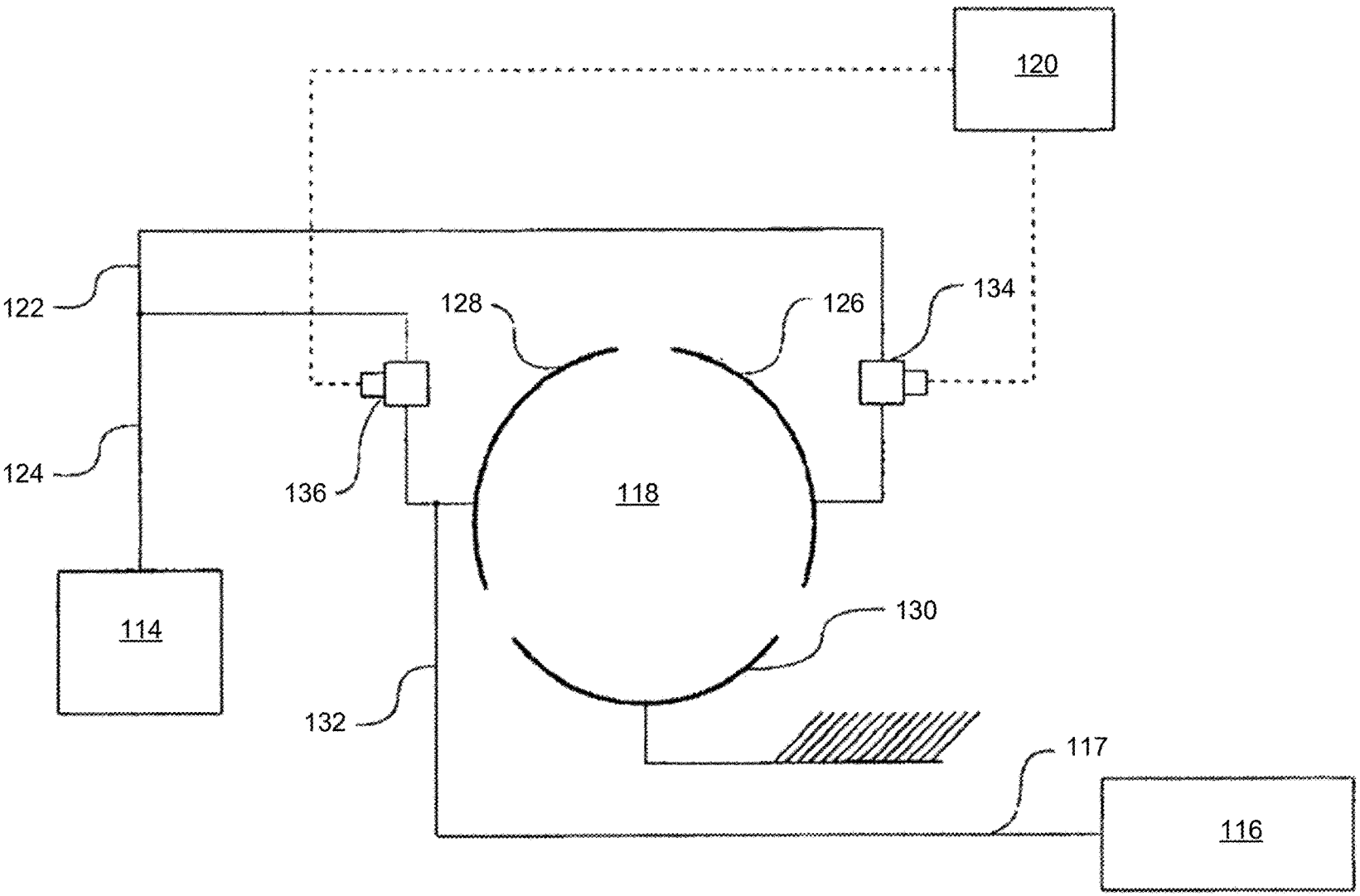
FIG. 2 is a diagram of a torque converter.

FIG. 2 is a diagram of a torque converter 118. The torque converter 118 may include a rotating housing 122 that is coupled to an output shaft 124 of the engine 114 to transmit power to the torque converter 118. The rotating housing 122 turns an impeller 126 that directs fluid to the blades of a turbine 128, causing the turbine 128 to rotate in an opposite direction. The turbine 128 directs the fluid to a stator 130 which is held against rotation in an opposite direction of the turbine 128 by a one-way clutch (not shown). The stator 130 redirects most of the fluid back to the impeller 126, thereby multiplying the torque output. The turbine 128 is connected to a torque converter output shaft 132 that is coupled to a transmission input shaft 117, thereby transmitting power to the transmission 116.

A disc-type impeller clutch 134 may be provided to control the coupling of the engine 114 to the impeller 126. A disc-type lock-up clutch 136 may also be provided for selectively coupling the rotating housing 122 to the turbine 128 for a direct mechanical connection that effectively bypasses the torque converter 118. Actuation of the clutch 134 and the clutch 136 may be controlled by the controller 120.

As indicated above, FIG. 2 is provided as an example. Other examples may differ from what is described with regard to FIG. 2.

Figure 3:
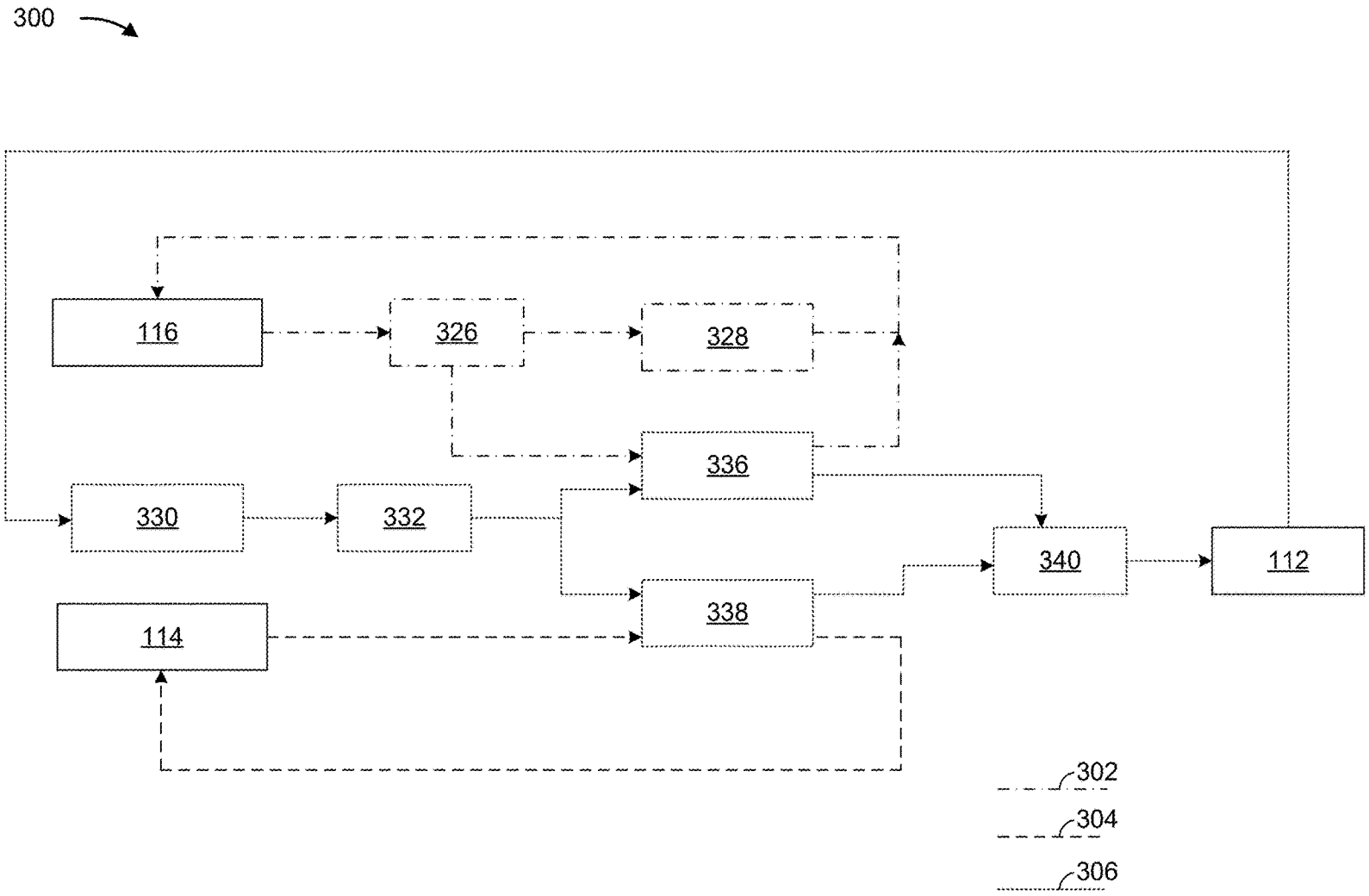
FIGS. 3-4 are diagrams of an example fluid system.
Figure 4:
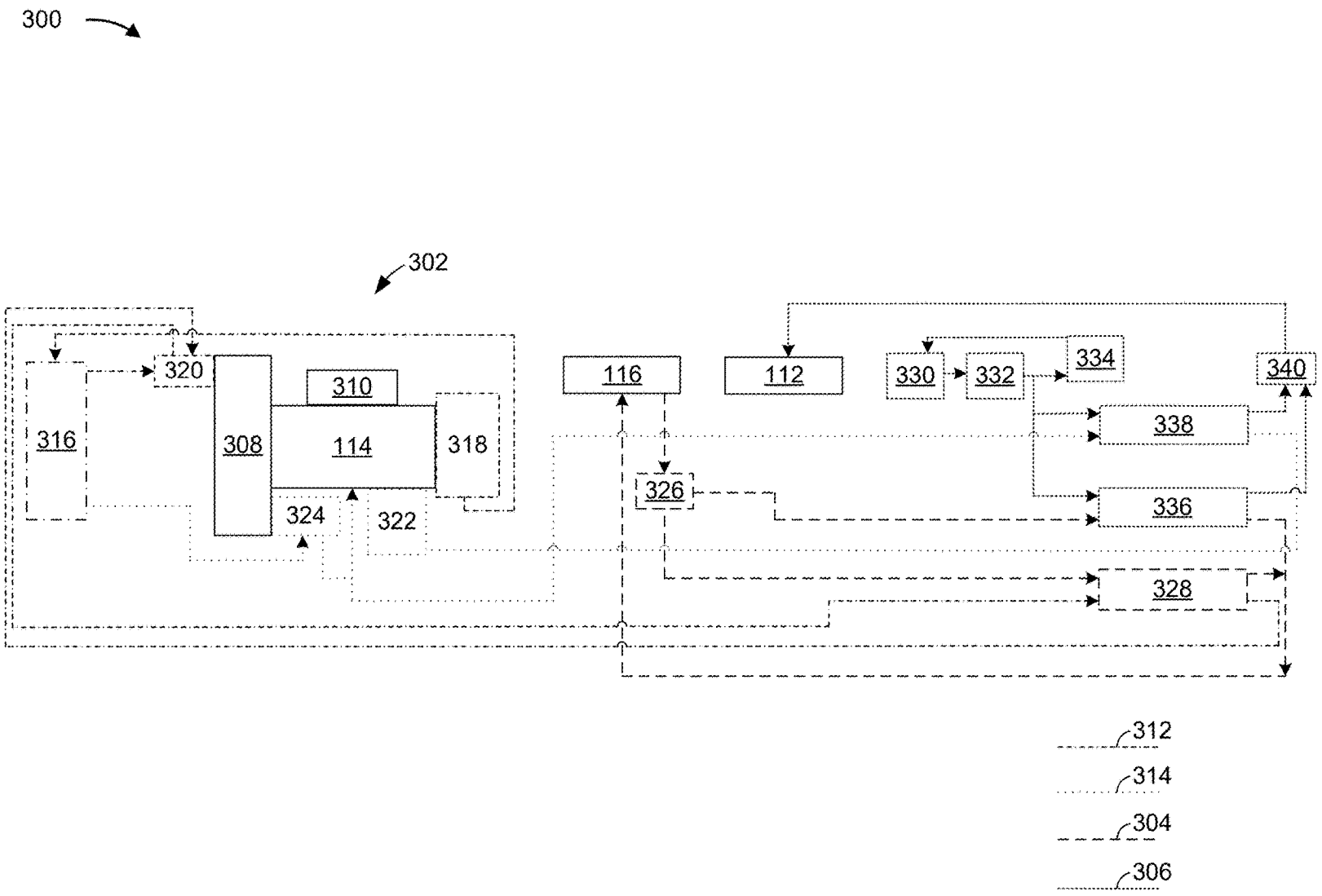

FIGS. 3-4 are diagrams of an example fluid system 300. FIG. 3 is a simplified depiction of the fluid system 300, while FIG. 4 is a more detailed depiction of the fluid system 300. The fluid system 300 includes an engine cooling system 302 configured to circulate engine coolant (e.g., water) in the engine 114, a transmission lubrication system 304 configured to circulate transmission oil in the transmission 116, and a pump lubrication system 306 configured to circulate lubrication oil in the fluid pump 112. Components of the fluid system 300 may be fluidly connected by fluid lines (e.g., fluid conduits), shown as lines with arrows to represent flow direction. In addition, as shown in FIG. 4, the engine 114 may include a front housing 308 and an engine oil cooler 310.

The engine cooling system 302 may include a coolant jacket system 312 (e.g., defining a fluid circuit) and/or a separate circuit after cooling (SCAC) system 314 (e.g., defining a fluid circuit). The engine cooling system 302 may include a heat exchanger 316 (e.g., a radiator) for cooling engine coolant (e.g., water) used by the coolant jacket system 312 and/or the SCAC system 314. The coolant jacket system 312 may include a jacket coolant regulator 318 and a jacket coolant pump 320. The SCAC system 314 may include a SCAC coolant regulator 322 and a SCAC coolant pump 324. The transmission lubrication system 304 (e.g., defining a fluid circuit) may include a temperature control valve 326 in a diverting configuration (e.g., relative to a flow direction of transmission oil), and a transmission oil cooler 328. The temperature control valve 326 may be a thermostatic control valve or an actuated control valve. In addition, the transmission lubrication system 304 may include a transmission oil sump (not shown) for the transmission, and a transmission oil pump (not shown) configured to pump transmission oil from the sump.

The pump lubrication system 306 may include a lubrication oil tank 330, a lubrication oil pump 332 configured to pump lubrication oil from the oil tank 330, and a pressure relief valve 334. The pump lubrication system 306 may include a lubrication oil heater 336 and a lubrication oil cooler 338. In some implementations, the lubrication oil heater 336 and the lubrication oil cooler 338 may be integrated into a single package. The lubrication oil heater 336 and the lubrication oil cooler 338 are in parallel. For example, the lubrication oil pump 332 may be configured to pump the lubrication oil from the lubrication oil tank 330 to the lubrication oil heater 336 and to the lubrication oil cooler 338 through respective fluid lines.

The lubrication oil heater 336 and the lubrication oil cooler 338 may be heat exchangers (e.g., coil-type heat exchanges, shell and tube heat exchangers, or the like). For example, the lubrication oil heater 336 may heat the lubrication oil circulated through the lubrication oil heater 336 using transmission oil (e.g., a lubrication oil fluid circuit and a transmission oil fluid circuit may both include the lubrication oil heater 336). In a lubrication oil warm-up mode of the transmission 116, as described in connection with FIG. 5, the transmission oil may be rapidly heated to facilitate heat transfer from the transmission oil to the lubrication oil. The temperature control valve 326 is configured to direct (e.g., divert) transmission oil to the lubrication oil heater 336, to heat the lubrication oil, if a temperature of the transmission oil is below a target temperature (e.g., 160° F.). Otherwise, the temperature control valve 326 is configured to direct transmission oil to the transmission oil cooler 328, to avoid overheating the transmission oil, if the temperature of the transmission oil is above the target temperature. The transmission oil cooler 328 may also be a heat exchanger. The transmission oil cooler 328 may cool the transmission oil using engine coolant from the engine cooling system 302

(e.g., a transmission oil fluid circuit and an engine coolant fluid circuit may both include the transmission oil cooler 328). For example, the transmission oil may be cooled using jacket coolant from the jacket coolant pump 320, as shown in FIG. 4.

The lubrication oil cooler 338 may cool the lubrication oil circulated through the lubrication oil cooler 338 using engine coolant from the engine cooling system 302 (e.g., a lubrication oil fluid circuit and an engine coolant fluid circuit may both include the lubrication oil cooler 338). For example, the lubrication oil may be cooled using SCAC coolant from the SCAC coolant pump 324.

Heated lubrication oil from the lubrication oil heater 336 and cooled lubrication oil from the lubrication oil cooler 338 may be directed to a lubrication oil mixer 340 of the pump lubrication system 306 (e.g., the lubrication oil mixer 340 is downstream of the lubrication oil heater 336 and the lubrication oil cooler 338). The lubrication oil mixer 340 may be a temperature control valve (e.g., a thermostatic control valve or an actuated control valve) in a mixing configuration (e.g., relative to a flow direction of lubrication oil). For example, the lubrication oil mixer 340 may be configured to mix heated lubrication oil from the lubrication oil heater 336 and cooled lubrication oil from the lubrication oil cooler 338. The lubrication oil mixer 340 may proportionally mix the heated lubrication oil and the cooled lubrication oil (e.g., by controlling flow rates of the heated lubrication oil and the cooled lubrication oil into the lubrication oil mixer 340) in accordance with a target outlet temperature (e.g., 140° F.). The lubrication oil mixer 340 may supply the mixed lubrication oil (e.g., that is at the target outlet temperature) to the fluid pump 112.

As indicated above, FIGS. 3-4 are provided as an example. Other examples may differ from what is described with regard to FIGS. 3-4.

Figure 5:
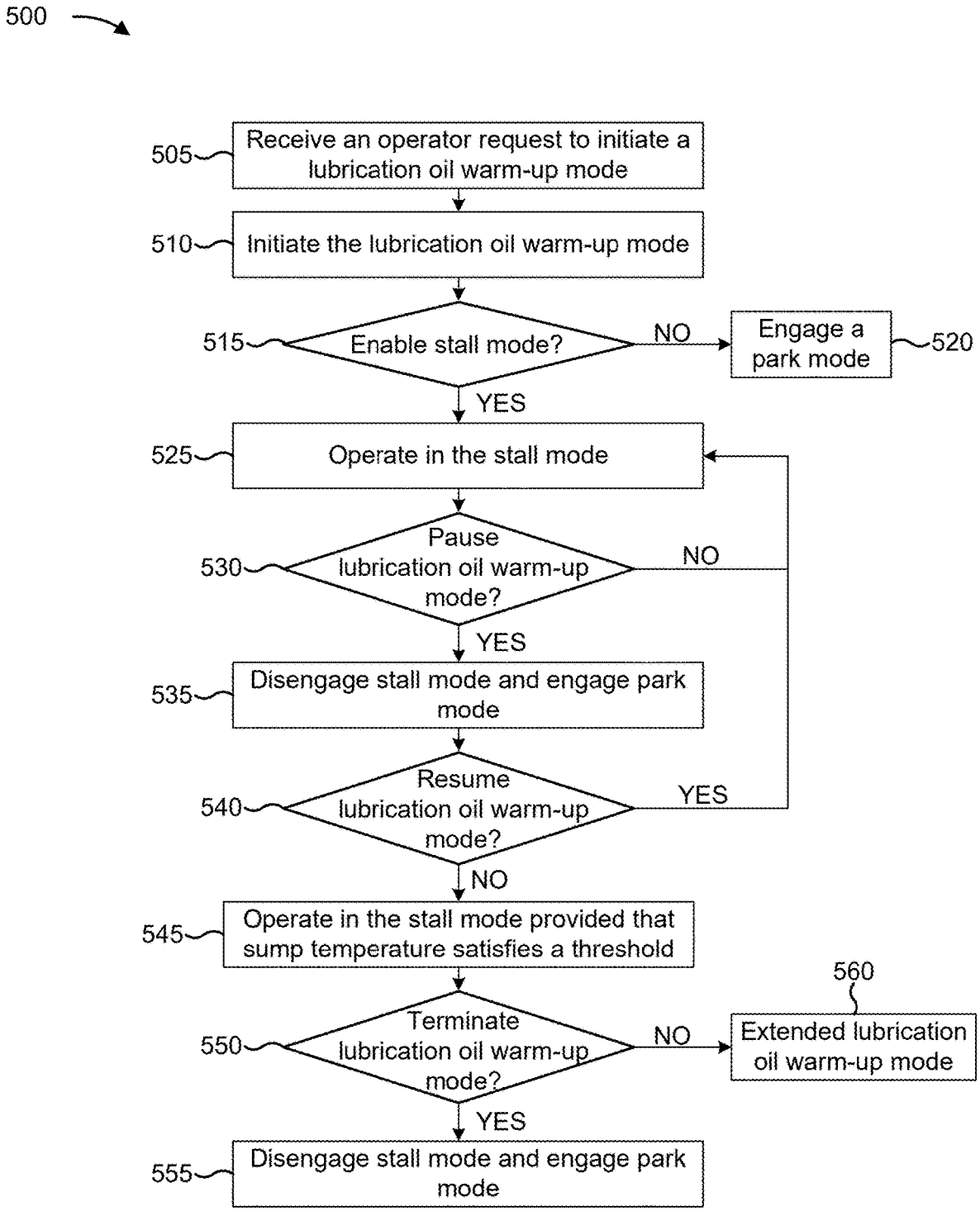
FIG. 5 is a flowchart of an example process associated with lubrication oil warm-up.

FIG. 5 is a flowchart of an example process 500 associated with lubrication oil warm-up. One or more process blocks of FIG. 5 may be performed by the controller 120. Additionally, or alternatively, one or more process blocks of FIG. 5 may be performed by another device or a group of devices separate from or including the controller, such as another device or component that is internal or external to the trailer 100.

As shown in FIG. 5, the controller 120 may receive an operator request (e.g., via an operator control, such as a button or a touchscreen) to initiate a lubrication oil warm-up mode (block 505). For example, the request to initiate the lubrication oil warm-up mode may be made when an ambient temperature, in which the fluid pump 112 is to operate (e.g., from a cold start), is relatively low. Thus, the lubrication oil warm-up mode may include operations that warm lubrication oil for the fluid pump 112 using the pump lubrication system 306. In some implementations, the controller 120 may monitor the ambient temperature and/or a temperature of the lubrication oil, and the controller 120 may automatically determine to initiate the lubrication oil warm-up mode responsive to the ambient temperature satisfying (e.g., not exceeding) a threshold and/or the lubrication oil temperature satisfying (e.g., not exceeding) a threshold. Additionally, or alternatively, the controller 120 may automatically determine to initiate the lubrication oil warm-up mode responsive to system initiation of the trailer 100 (e.g., the controller 120 may receive an initiation signal from a keyed or keyless ignition switch).

The controller 120 may initiate the lubrication oil warm-up mode responsive to the operator request or responsive to the controller 120 automatically determining to initiate the lubrication oil warm-up mode (block 510). The lubrication oil warm-up mode may utilize a stall mode of the transmission 116. Before initiating the stall mode, the controller 120 may perform a check as to the operational status of the trailer 100. Generally, it is not desirable to employ the stall mode when the trailer 100 is in operation. Moreover, the torque converter 118 should be released from normal operations. Accordingly, the controller 120 may determine whether the engine 114 is "idling," where the transmission 116 is not engaged to transmit power. In some examples, the controller 120 may perform a check as to whether stall enable conditions are met (e.g., conditions for operating the transmission 116 in the stall mode).

The stall enable conditions may include a condition that a torque converter temperature of the transmission oil (e.g., a temperature of the transmission oil measured at, on, in, or from the torque converter 118) satisfies (e.g., is less than) a threshold (e.g., the torque converter temperature of the transmission oil is less than 110° Celsius (C)). The stall enable conditions may include a condition that a sump temperature of the transmission oil (e.g., a temperature of the transmission oil measured on, at, in, or from a sump of the transmission 116) satisfies (e.g., is less than) a threshold (e.g., the sump temperature of the transmission oil is less than 87° C.). The stall enable conditions may include a condition that a speed (e.g., revolutions per minute (rpm)) of the engine 114 is within a target range (e.g., the speed of the engine 114 is in a range from 500 to 1025 rpm). The stall enable conditions may include a condition that an output speed of the transmission 116 is zero. The stall enable conditions may include a condition that clutch solenoid faults are absent (e.g., from the transmission 116 and/or the torque converter 118).

The controller 120 may determine whether to enable the stall mode based on whether one or more stall enable conditions are met (block 515). At block 515—NO, if the stall enable conditions are not met (e.g., at least one, at least two, at least three, at least four, or all the stall enable conditions are not met), the controller 120 may cause the transmission 116 to engage a park mode (block 520). Here, the controller 120 may terminate the lubrication oil warm-up mode, or the controller 120 may continue to check whether the stall enable conditions are met. At block 515—YES, based on the stall enable conditions being met, the controller 120 may cause the transmission 116 to operate in the stall mode (block 525). For example, in the lubrication oil warm-up mode, the controller 120 may cause the transmission 116 to operate in the stall mode to transfer heat to the transmission oil (e.g., which is transferred to the lubrication oil for the fluid pump 112 via the lubrication oil heater 336).

To cause the transmission 116 to operate in the stall mode, the controller 120 may cause restriction of rotation of the turbine 128 of the torque converter 118. In particular, to cause restriction of rotation of the turbine 128, the controller 120 may cause actuation of a clutch of the turbine 128 and/or the transmission 116. As an example, the controller 120 may provide a control signal to the transmission 116 to restrict the transmission input shaft 117, through, for example, one or more clutches associated therewith. Complete restriction causes a stall condition that prevents rotation of the torque converter output shaft 132 and the turbine 128. When power passes from the engine 114 through the output shaft 124 and rotationally engaged impeller 126, fluid flow is directed over the now stationary turbine 128. A pressure drop is created by the fluid flow passing over the blades of the stationary turbine 128. This pressure drop generates heat that is conveyed from the torque converter 118 to the transmission oil, thereby rapidly heating the transmission oil.

The stall mode may be cycled to avoid overheating the transmission oil. For example, after commencing the stall mode, the controller 120 may perform a check as to whether pause conditions are met. The pause conditions may indicate whether the lubrication oil warm-up mode, and the stall mode, are to be paused. The pause conditions may include a condition that a torque converter temperature of the transmission oil satisfies (e.g., is greater than) a threshold (e.g., the torque converter temperature of the transmission oil is greater than 160° F.). The pause conditions may include a condition that a sump temperature of the transmission oil satisfies (e.g., is less than) a threshold (e.g., the sump temperature of the transmission oil is less than 155° F.).

The controller 120 may determine whether to pause the lubrication oil warm-up mode and the stall mode based on whether one or more pause conditions are met (block 530). At block 530—NO, if the pause conditions are not met (e.g., at least one, or all of, the pause conditions are not met), operation in the stall mode may continue. At block 530—YES, if the pause conditions are met (e.g., all of the pause conditions are met), the controller 120 may cause the transmission 116 to disengage the stall mode and to engage a park mode (block 535). For example, the controller 120 may cause, for a pause duration, the transmission 116 to disengage the stall mode and to engage the park mode to thereby pause the lubrication oil warm-up mode (e.g., responsive to the torque converter temperature of the transmission oil satisfying the threshold, such as the torque converter temperature being greater than 160° F.). In some examples, the pause duration may be 60 seconds. Pausing the lubrication oil warm-up mode allows the transmission oil to cool down to avoid overheating of the transmission oil.

Following the pause duration, the controller 120 may perform a check as to whether resume conditions are met. The resume conditions may indicate whether the lubrication oil warm-up mode, and the stall mode, are to be resumed. The resume conditions may include a condition that a torque converter temperature of the transmission oil satisfies (e.g., is less than) a threshold (e.g., the torque converter temperature of the transmission oil is less than 110° C.). The resume conditions may include a condition that a speed of the engine 114 is within a target range (e.g., the speed of the engine 114 is in a range from 500 to 1025 rpm). The resume conditions may include a condition that an output speed of the transmission 116 is zero. The resume conditions may include a condition that clutch solenoid faults are absent (e.g., from the transmission 116 and/or the torque converter 118). Thus, the resume conditions may be similar to the stall enable conditions described herein, and thresholds used for the resume conditions may be the same as thresholds used for the stall enable conditions.

The controller 120 may determine whether to resume the lubrication oil warm-up mode and the stall mode based on whether one or more resume conditions are met (block 540). At block 540—YES, if the resume conditions are met (e.g., all of the resume conditions are met), the controller 120 may cause, after the pause duration, the transmission 116 to resume operating in the stall mode to thereby resume the lubrication oil warm-up mode. The controller 120 may cause cycling between causing the transmission 116 to disengage the stall mode and to engage the park mode for the pause duration, and causing the transmission 116 to operate in the stall mode after the pause duration, for one or more (e.g., multiple) cycles (e.g., until the resume conditions are not met or termination conditions are met, as described below).

In some examples, if the resume conditions are not met (block 540—NO), at block 545, the controller 120 may cause the transmission 116 to operate in the stall mode to thereby resume the lubrication oil warm-up mode based on the sump temperature of the transmission oil satisfying (e.g., being greater than) a threshold (e.g., the sump temperature of the transmission oil is greater than 155° F.). The controller 120 may perform a check as to whether termination conditions are met. The termination conditions may indicate whether the lubrication oil warm-up mode, and the stall mode, are to be terminated. The termination conditions may include a condition that the sump temperature of the transmission oil satisfies (e.g., is greater than) a threshold (e.g., the sump temperature of the transmission oil is greater than 93° C.). The termination conditions may include a condition that the torque converter temperature of the transmission oil satisfies (e.g., is greater than) a threshold (e.g., the torque converter temperature of the transmission oil is greater than 115° C.).

The controller 120 may determine whether to terminate the lubrication oil warm-up mode and the stall mode based on whether one or more termination conditions are met (block 550). At block 550—YES, if the termination conditions are met (e.g., at least one, or all of the termination conditions are met), the controller 120 may cause the transmission 116 to disengage the stall mode and to engage a park mode (block 555). For example, responsive to the sump temperature of the transmission oil satisfying the threshold, the controller 120 may cause the transmission 116 to disengage the stall mode and to engage the park mode to terminate the lubrication oil warm-up mode. At block 550—NO, if the termination conditions are not met (e.g., all of the termination conditions are not met), the controller 120 may initiate an extended lubrication oil warm-up mode (block 560). The extended lubrication oil warm-up mode may proceed in a similar manner as the lubrication oil warm-up mode, but using a longer pause duration, such as 65 seconds. After termination of the lubrication oil warm-up mode, the lubrication oil mixer 340 may continue to mix heated lubrication oil from the lubrication oil heater 336 and cooled lubrication oil from the lubrication oil cooler 338, as described herein. In this way, the lubrication oil supplied to the fluid pump 112 may be maintained at or near the target outlet temperature (e.g., 140° F.) to maintain high-performance operation and durability of the fluid pump 112.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The fluid system 300 described herein may be used with any fluid pump that is lubricated by a lubrication oil. For example, the fluid system 300 may be used with a hydraulic fracturing system or a hydraulic fracturing trailer that includes a fluid pump, an engine, and a transmission. Thus, the fluid system 300 may be used in support of hydraulic fracturing operations for recovery of water, oil, natural gas, and/or other fluids. In a cold environment, it may take several hours of engine idling to warm lubrication oil sufficiently for reliable and high-performance operation of a fluid pump, leading to significant downtime of the pump.

The fluid system 300 described herein is useful for efficiently warming lubrication oil for a fluid pump. In particular, the fluid system 300 may rapidly heat transmission oil using a transmission stall operation, and the hot transmission oil may be used in a heat exchanger to warm the lubrication oil. In this way, the lubrication oil may be warmed faster (e.g., in 30 minutes or less) in a cold environment, reducing pump downtime and facilitating reliable and high-performance operation of the pump. Furthermore, the transmission stall operation may be cycled to avoid overheating of the transmission oil, which may otherwise damage the transmission or reduce an efficacy of the transmission oil.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

When "a controller" or "one or more controllers" is described or claimed (within a single claim or across multiple claims) as performing multiple operations or being configured to perform multiple operations, this language is intended to broadly cover a variety of controller architectures and environments. For example, unless explicitly claimed otherwise (e.g., via the use of "first controller" and "second controller" or other language that differentiates controllers in the claims), this language is intended to cover a single controller performing or being configured to perform all of the operations, a group of controllers collectively performing or being configured to perform all of the operations, a first controller performing or being configured to perform a first operation and a second controller performing or being configured to perform a second operation, or any combination of controllers performing or being configured to perform the operations. For example, when a claim has the form "one or more controllers configured to: perform X; perform Y; and perform Z," that claim should be interpreted to mean "one or more controllers configured to perform X; one or more (possibly different) controllers configured to perform Y; and one or more (also possibly different) controllers configured to perform Z."

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, as used herein, satisfying a threshold may, depending on the context, refer to a value being greater than the threshold, greater than or equal to the threshold, less than the threshold, less than or equal to the threshold, equal to the threshold, not equal to the threshold, or the like.

What is claimed is:

1. A fluid system, comprising:

an engine cooling system to circulate engine coolant in an engine;

a transmission lubrication system to circulate transmission oil in a transmission;

a pump lubrication system to circulate lubrication oil in a fluid pump, the pump lubrication system comprising:

a lubrication oil heater to heat the lubrication oil circulated through the lubrication oil heater using the transmission oil;

a lubrication oil cooler, in parallel with the lubrication oil heater, to cool the lubrication oil circulated through the lubrication oil cooler using the engine coolant; and a lubrication oil mixer to mix heated lubrication oil from the lubrication oil heater and cooled lubrication oil from the lubrication oil cooler, and to supply mixed lubrication oil to the fluid pump; and a controller configured to cause, in a lubrication oil warm-up mode, the transmission to operate in a stall mode that transfers heat to the transmission oil.

2. The fluid system of claim 1, wherein the lubrication oil heater is a first heat exchanger and the lubrication oil cooler is a second heat exchanger.

3. The fluid system of claim 1, wherein the lubrication oil mixer is a temperature control valve in a mixing configuration.

4. The fluid system of claim 1, wherein the transmission lubrication system comprises:

a temperature control valve in a diverting configuration; and a transmission oil cooler.

5. The fluid system of claim 4, wherein the temperature control valve is configured to direct the transmission oil to the transmission oil cooler if a temperature of the transmission oil is above a target temperature, and to direct the transmission oil to the lubrication oil heater if the temperature of the transmission oil is below the target temperature.

6. The fluid system of claim 1, wherein the pump lubrication system further comprises:

a lubrication oil tank; and a lubrication oil pump configured to pump the lubrication oil from the lubrication oil tank to the lubrication oil heater and to the lubrication oil cooler.

7. The fluid system of claim 1, wherein the engine cooling system is a separate circuit after cooling (SCAC) system.

8. The fluid system of claim 1, wherein the controller, to cause the transmission to operate in the stall mode, is configured to:

cause restriction of rotation of a turbine of a torque converter for the transmission.

9. The fluid system of claim 8, wherein the controller, to cause restriction of rotation of the turbine of the torque converter, is configured to:

cause actuation of a clutch of at least one of the turbine or the transmission.

10. The fluid system of claim 1, wherein the controller, to cause the transmission to operate in the stall mode, is configured to:

cause the transmission to operate in the stall mode based on stall enable conditions being met, wherein the stall enable conditions include:

a torque converter temperature of the transmission oil satisfies a first threshold, a sump temperature of the transmission oil satisfies a second threshold, a speed of the engine is within a target range, an output speed of the transmission is zero, and clutch solenoid faults are absent.

11. The fluid system of claim 1, wherein the controller is further configured to:

cause, for a pause duration, the transmission to disengage the stall mode and to engage a park mode, to pause the lubrication oil warm-up mode, responsive to a torque converter temperature of the transmission oil satisfying a threshold; and cause the transmission to operate in the stall mode, to resume the lubrication oil warm-up mode, after the pause duration.

12. The fluid system of claim 1, wherein the controller is further configured to:

cause the transmission to disengage the stall mode and to engage a park mode, to terminate the lubrication oil warm-up mode, responsive to a sump temperature of the transmission oil satisfying a threshold.

* * * * *